US005899138A

United States Patent [19]

Yamanaka

[11] Patent Number: 5,899,138

[45] **Date of Patent: * May 4, 1999**

[54] SHEET-BUNDLE CONVEYING DEVICE WITH LOW DISTURBANCE CONVEYANCE AND STACKING FEATURES

[75] Inventor: Yuji Yamanaka, Kawasaki, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/975,443

[22] Filed: Nov. 21, 1997

Related U.S. Application Data

[63] Continuation of application No. 08/684,637, Jul. 22, 1996, abandoned.

[30] Foreign Application Priority Data

Jul. 25, 1995 [JP] Japan ..... 7-189377

[51] Int. Cl.[6] ..... B65B 27/08

[52] U.S. Cl. ..... 100/7; 270/58.12; 270/58.17; 270/58.27; 412/33; 414/790

[58] Field of Search ..... 100/7, 33 R, 33 PB; 270/58.08, 58.11–58.13, 58.17, 58.27; 412/33; 414/789.9, 790

[56] References Cited

U.S. PATENT DOCUMENTS

| | | | |
|---|---|---|---|
| 2,933,314 | 4/1960 | Stobb | 100/7 |
| 4,171,127 | 10/1979 | Kish et al. | 270/58.27 |
| 4,397,229 | 8/1983 | Merwarth et al. | 100/7 |
| 4,401,021 | 8/1983 | Noll, Jr. | 100/7 |
| 4,898,372 | 2/1990 | Hirabayashi et al. | 270/58.12 |
| 4,993,697 | 2/1991 | Yamashita et al. | 270/58.17 |
| 5,384,634 | 1/1995 | Takehara et al. | 270/58.27 |
| 5,392,700 | 2/1995 | Kleinhen | 100/7 |
| 5,447,298 | 9/1995 | Watanabe et al. | 270/58.11 |
| 5,460,359 | 10/1995 | Toyohara et al. | 100/7 |
| 5,540,421 | 7/1996 | Ohta et al. . | |
| 5,569,011 | 10/1996 | Yamaguchi et al. . | |
| 5,569,012 | 10/1996 | Kosasa et al. . | |
| 5,632,587 | 5/1997 | Coyette | 270/58.12 |

*Primary Examiner*—Stephen F. Gerrity
*Attorney, Agent, or Firm*—Fitzpatrick, Cella, Harper & Scinto

[57] ABSTRACT

A sheet-bundle conveying device receives a plurality of sheets and conveys a bundle of the sheets. The device includes a first tray having a contact portion where the leading edges of the sheets contact, and being swingable between a first position, inclined so that the contact portion is lowered, for receiving the sheets and a second position for transferring the received sheet bundle, and a second tray for receiving the sheet bundle from the first tray moved to the second position and for rectilinearly moving in a state of conveying the sheet bundle.

21 Claims, 20 Drawing Sheets

SHEET-BUNDLE CONVEYING DEVICE WITH LOW DISTURBANCE CONVEYANCE AND STACKING FEATURES

This application is a continuation of application Ser. No. 08/684,637, filed Jul. 22, 1996, now abandoned.

BACKGROUND OF THE INVENTION

1. Field of the Invention

This invention relates to a sheet-bundle conveying device, and more particularly, to a bound-bundle conveying device for binding a bundle of sheets and conveying the bound bundle, and to a binding apparatus including the device.

2. Description of the Related Art

In the related art, as shown in FIG. 20, a binding apparatus 1 includes a sheet conveying device 201, a sheet aligning device 202, a sheet-bundle conveying device 203, a tape heating device 204, a tape conveying device 205, and an accommodating stacker 207.

The sheet conveying device 201 has a sheet conveying path 2 for a received sheet S. A receiving port 2*a* and a discharging port 2*b* are provided in the sheet conveying path 2, and a pair of receiving rollers 3, a plurality of pairs of conveying rollers 4, and a pair of discharging rollers 5 are disposed from the upstream side along the sheet conveying path 2. A flapper 6, serving as branch means, is disposed at the downstream side in the vicinity of the pair of receiving rollers 3. The flapper 6 causes the sheet conveying path 2 to branch to a sheet conveying path 7 when performing binding.

The sheet S branching to the sheet conveying path 7 by the flapper 6 is conveyed to the sheet aligning device 202 by a pair of sheet conveying rollers 8 comprising components 8*a* and 8*b*.

The sheet aligning device 202 comprises an accommodating tray 9 for accommodating sheets, an aligning fence 10 for aligning the sides of the sheets parallel to the sheet conveying direction, an aligning paddle 11 for aligning the sides of the leading edges of the sheets in the sheet conveying direction, a stop finger 12 for temporarily holding the sheets at each binding operation, a leading-edge reference shutter 13 with which the leading edges of the sheets are brought into contact, a lower entrance guide 14 for guiding the lower surface of each sheet at an entrance of the device, and an upper entrance guide 15 for guiding the upper surface of the sheet at the entrance of the device.

The sheet S received in the sheet aligning device 202 contacts the leading-edge reference shutter 13 while the upper surface and the lower surface of the sheet S are guided by the upper entrance guide 15 and the lower entrance guide 14, respectively. At that time, alignment of the sheet S in the sheet conveying direction and alignment of sides of the sheet S parallel with the sheet conveying direction are performed by the aligning paddle 11 and the aligning fence 10, respectively, on the accommodating tray 9.

The sheet-bundle conveying device 203 comprises a movable grip plate 17, a fixed grip plate 16, a sheet-bundle guide 18 and the like.

Upon completion of alignment of sheets by the sheet aligning device 202, a grasping driving mechanism (not shown) for the movable grip plate 17 operates to move the movable grip plate 17 in order to grasp the bundle of the aligned sheets together with the fixed grip plate 16. Upon completion of grasping of the sheet bundle, a moving mechanism (not shown) for the movable grip plate 17 and the fixed grip plate 16 operate to convey the aligned sheet bundle from the sheet aligning device 202 to the tape heating device 204 in the state of the sheet bundle being grasped.

At that time, the lower side of the rear end of the sheet bundle is guided and supported by the sheet-bundle guide 18.

The sheet-bundle guide 18 also moves together with the movable grip plate 17 and the fixed grip plate 16.

The tape heating device 204 comprises tape guides 19 and 20, a central heater 21, side heaters 22 and 23, a driving mechanism 24 for the central heater 21, a driving mechanism 25 for the side heaters 22 and 23, and the like.

A binding tape 26 is supplied to the tape guides 19 and 20 of the tape heating device 204 by the tape conveying device 205 before the aligned sheet bundle is conveyed by the sheet-bundle conveying device 203.

The tape conveying device 205 comprises tape reels R1 and R2, a carriage conveyor C, a tape cutter 42, tape conveying means 43 and the like.

A tape wound around the tape reels R1 and R2 is cut into a predetermined length by the tape cutter 42 to provide the binding tape 26, which is conveyed into the carriage conveyor C by the tape conveying means 43.

When the binding tape 26 has been conveyed into the carriage conveyor C by the tape conveying means 43, the central heater 21 moves from a retracted position (not shown) to a heating position by the driving mechanism 24 for the central heater 21 and starts preheating of the binding tape 26. When the aligned sheet bundle has been conveyed to a back contact position H by the sheet-bundle conveying device 203, the back side of the sheet bundle is bound.

The bound sheet bundle is accommodated within the accommodating stacker 207 by being gripped by a gripper comprising the movable grip plate 17 and the fixed grip plate 16.

Thus, the sheet bundle moves from the aligning device 202 to the tape heating device 204 (serving as a binding unit) and then to the accommodating stacker 207 (serving as an accommodating unit) by being gripped by the gripper.

In the above-described related art approach separate rails and driving systems are provided for six operations, i.e., a (grasping), b (movement), c (movement), d (rotation), e (movement) and f (movement between the front side and the rear side), and many of the driving systems are included within moving members, thereby providing a complicated and high-cost configuration.

In the conventional approach, if the operations d and e are omitted, a bound bundle drops when being accommodated. Hence, a shock is produced by the impact on the bound bundle, and disturbance is generated in the bound bundle.

In the related art approach, since the gripper for holding the sheet bundle is moved by the driving system having degrees of freedom in six directions, the following disadvantages are present. That is, (1) a large amount of cost is required for the driving system for the gripper, and (2) the size of the device increases.

SUMMARY OF THE INVENTION

It is an object of the present invention to solve the above-described problems.

It is another object of the present invention to provide a sheet-bundle conveying device which can smoothly convey a sheet bundle.

According to one aspect, the present invention, which achieves these objectives, relates to a sheet-bundle conveying device for receiving a plurality of sheets and conveying a bundle of the sheets, comprising first tray means having a contact portion where the leading edges of the sheets contact, and being swingable between a first position, inclined so that the contact portion is lowered, for receiving the sheets and a second position for transferring the received sheet bundle, and second tray means for receiving the sheet bundle from the first tray means moved to the second position and for rectilinearly moving and for conveying the sheet bundle.

According to a preferred embodiment, the first tray means can pass through openings formed in the second tray means. When the first tray means passes through the openings formed in the second tray means, the sheet bundle is transferred to the second tray means.

According to another embodiment, the first tray means is supported by supporting means so that, when the first tray means transfers the sheet bundle to the second tray means, a rear portion of the first tray means descends lower than the second tray means, and subsequently a contact portion of the first tray means descends.

According to still another embodiment, the supporting means comprises a first driving link for rotatably supporting the first tray means, and a second driving link for slidably/rotatably supporting the first tray means in cooperation with the first driving link.

According to yet another embodiment, the driving links are fixed to a first driving shaft and a second driving shaft, respectively, and the driving shafts are driven by a single drive source.

According to yet a further embodiment, the device further comprises a stacker for receiving the bound sheet bundle conveyed by the second tray means. The second tray means is vertically movable in order to transfer the sheet bundle to the stacker.

According to another aspect, the present invention, which achieves these objectives, relates to a sheet-bundle conveying device for receiving a plurality of sheets and conveying a bundle of the sheets, comprising first tray means having a contact portion where the leading edges of the sheets contact, and being movable between a first position for receiving the sheets and a second position for transferring the received sheet bundle, and second tray means for receiving the sheet bundle from the first tray means moved to the second position and for conveying the sheet bundle. When the first tray means passes through opening formed in the second tray means, the sheet bundle is caused to remain on the second tray means. The first tray means is supported by supporting means so that, when the first tray means transfers the sheet bundle to the second tray means, a rear portion of the first tray means descends lower than the second tray means, and subsequently, the contact portion of the first tray means descends.

According to still another aspect, the present invention, which achieves these objectives, relates to a sheet-bundle conveying device comprising a first tray for receiving vertically movable sheets, a second tray for receiving the sheets when the first tray descends through openings formed in the second tray means, moving means for moving the second tray in a direction crossing the descending direction, vertically moving means for vertically moving the first tray, and conveying means vertically movable as one body while supporting the first tray, the second tray, the moving means, and the vertically moving means.

A binding apparatus according to the present invention includes an aligning device for aligning sheets which are sequentially fed, a sheet-bundle conveying device for conveying an aligned bundle of the sheets to a binding portion while gripping the aligned sheet bundle, and a bound-bundle conveying device for conveying the bound bundle bound in the bounding portion to a bound-bundle accommodating portion. The apparatus uses the above-described sheet-bundle conveying device.

According to the above-described features, while a bundle of sheets mounted on a tray having a predetermined angle tend to slide down due to gravity, its position is maintained by contacting a contact portion.

In addition, the rotation and vertical movement of a rotating tray can be effected by the torque of a single drive source. By changing the ratio of the number of revolutions of a first driving shaft to the number of revolutions of a second driving shaft, or by changing the ratio of the length of a first driving link to the length of a second driving link, a predetermined angle can be arbitrarily set. By changing the length of the first driving link, the amount of vertical movement of the rotating tray can be set.

A sheet bundle mounted on a tray can be transferred to a second tray by lowering of the tray from a raised position to a lowered position below the second tray.

When binding a sheet bundle with a predetermined angle as in the present invention, the bound bundle must be transferred from the state of the predetermined angle to an accommodating state (a horizontal state). Particularly, a bound bundle immediately after glue binding is not yet completely fixed, and therefore must not be disturbed. According to the above-described configuration, a bound bundle can be transferred by supporting substantially the lower surface of the bundle without disturbing the bound bundle.

A sheet bundle mounted on the tray tends to slide down due to inclination of the tray when it is transferred to the second tray. However, by arranging such that the contact portion finally descends under the second tray, sliding down of the tray can be prevented, and the position of the sheet bundle transferred on the second tray is maintained constant.

As described above, according to the present invention, a sheet-bundle conveying device which can smoothly convey a sheet bundle can be provided.

Furthermore, according to the present invention, the size of the device can be reduced.

DESCRIPTION OF THE PREFERRED EMBODIMENT

Figure 1:
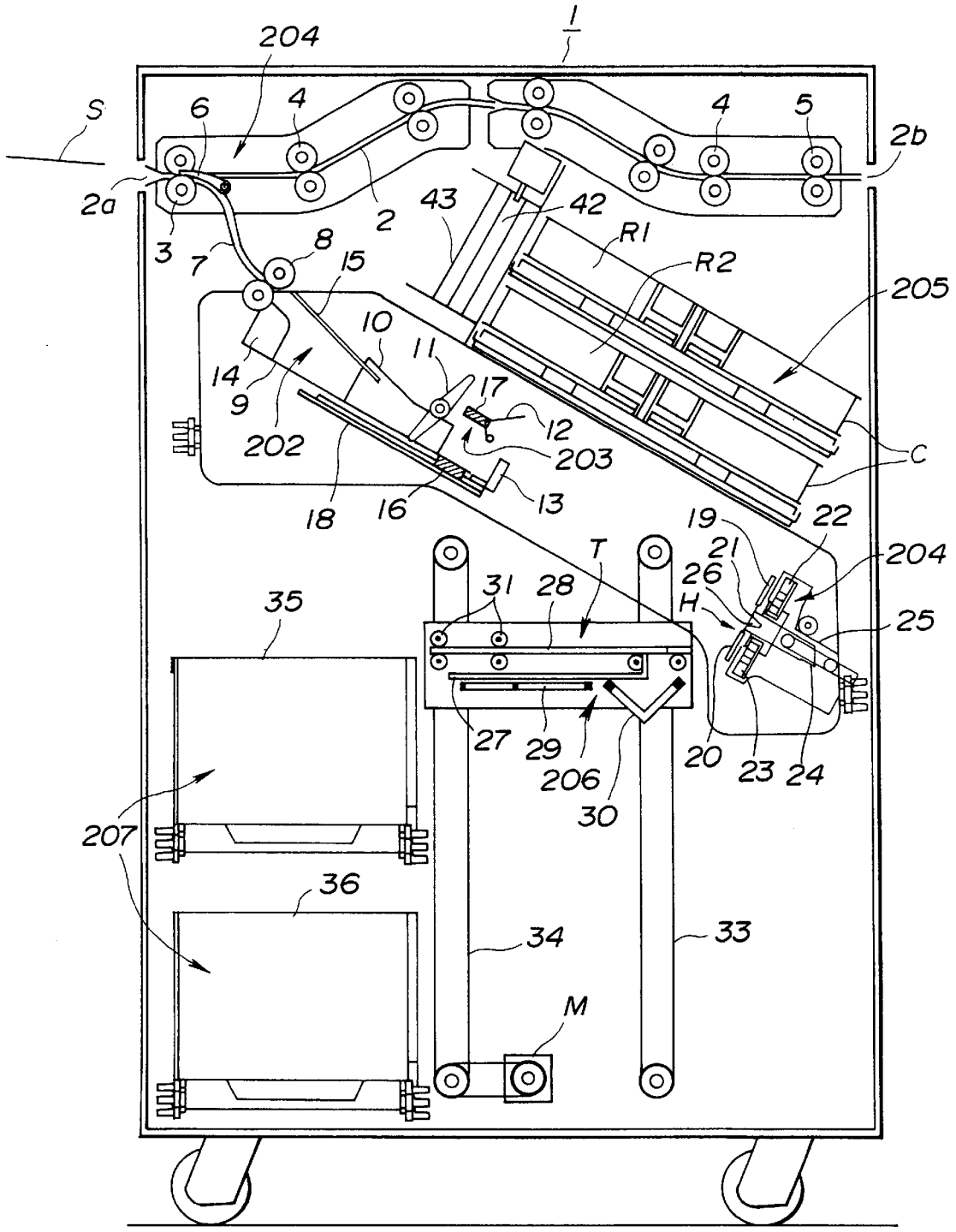
FIG. 1 is a side view of a binding apparatus which uses a bound-bundle conveying device according to a preferred embodiment of the present invention.

A preferred embodiment of the present invention will now be described with reference to the drawings. Components identical or similar to those described in the related art are indicated by the same reference characters, and a further description thereof will, in some cases, be omitted.

As shown in FIG. 1, a binding apparatus 1 according to the preferred embodiment comprises a sheet conveying device 201, a sheet aligning device 202, a sheet-bundle conveying device 203, a tape heating device 204, a tape conveying device 205, a bound-bundle conveying device 206, and an accommodating stacker 207.

Figure 2:
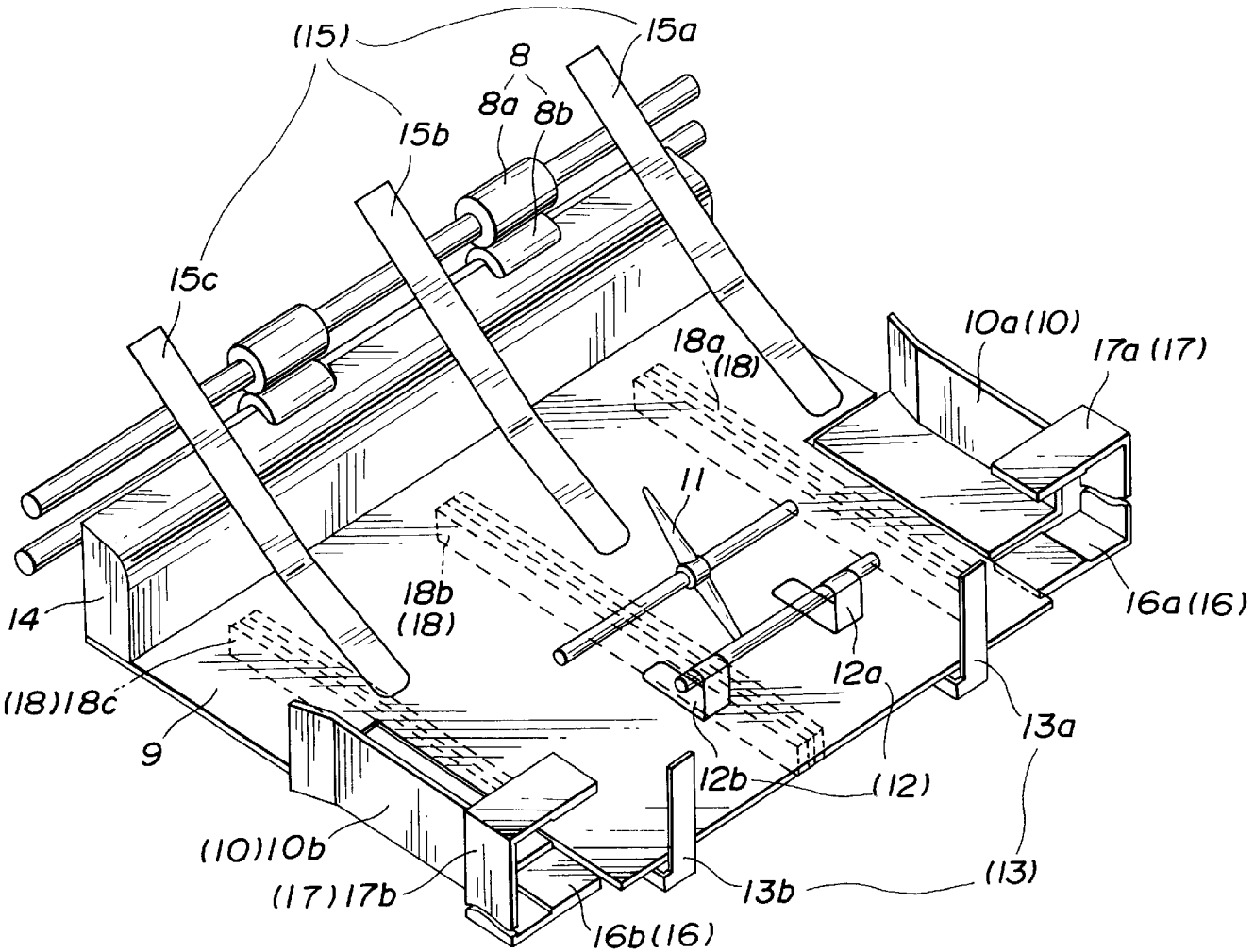
FIG. 2 is a perspective view of a sheet aligning device.
Figure 3A:
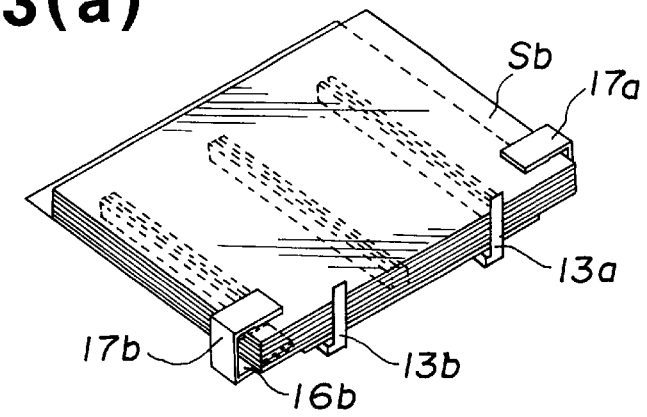
FIGS. 3(*a*) through 4(*c*) are diagrams illustrating conveyance of sheets.
Figure 3B:
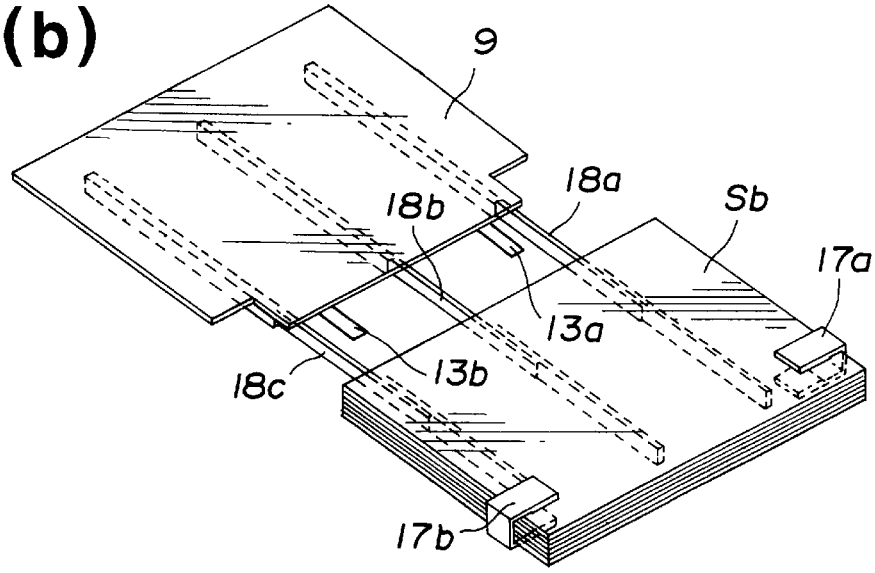
Figure 3C:
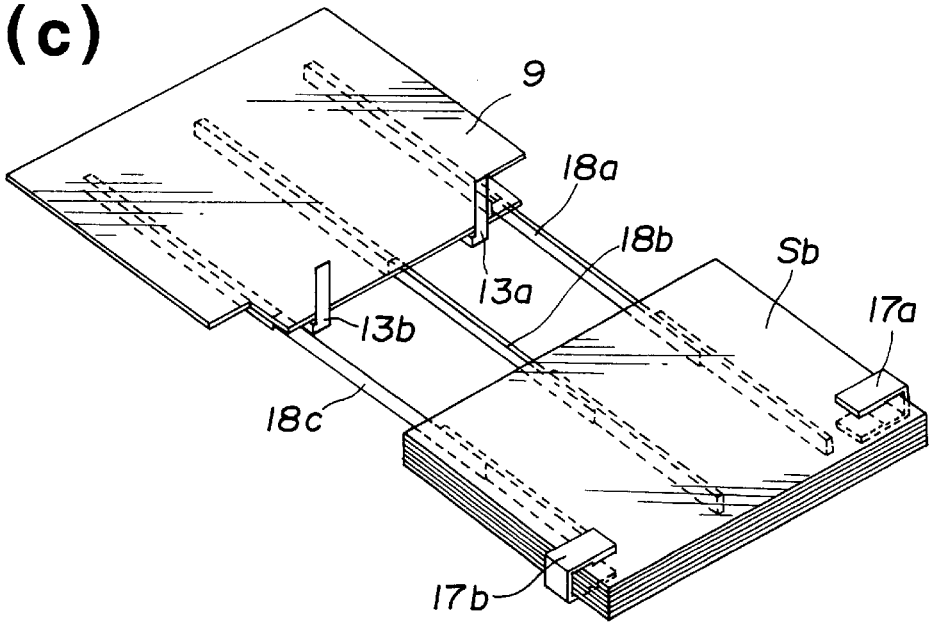

As shown in FIGS. 2 and 3(*a*), the upper surface and the lower surface of a sheet S conveyed to the sheet aligning device 202 are guided by an upper entrance guide 15, comprising components 15*a*, 15*b* and 15*c*, and a lower entrance guide 14, respectively, and the sheet S contacts a leading-edge reference shutter 13 comprising components 13*a* and 13*b*. At that time, the alignment of the sheet S in the conveying direction and the alignment of sides of the sheet S parallel with the conveying direction are performed by an aligning paddle 11 and an aligning fence 10, comprising components 10*a* and 10*b*, respectively, on an accommodating tray 9.

More specifically, the aligning fence 10 comprises a fixed fence 10*a* and a movable fence 10*b*. The sheet is aligned using the fixed fence 10*a* as a reference. When continuously performing binding, a sheet bundle is temporarily held by operating a stop finger 12 comprising components 12*a* and 12*b*. After the preceding aligned sheet bundle has been conveyed from the accommodating tray 9, the waiting sheet bundle is transferred onto the accommodating tray 9 by releasing the stop finger 12 comprising components 12*a* and 12*b*.

The sheet-bundle conveying device 203 comprises a movable grip plate 17 comprising components 17*a* and 17*b*, a fixed grip plate 16 comprising components 16*a* and 16*b*, a gripping driving mechanism (not shown) for the movable grip plate 17, a moving mechanism (not shown) for the movable grip plate 17 and the fixed grip plate 16, a sheet-bundle guide 18 comprising components 18*a*, 18*b*, and 18*c*, and the like.

Upon completion of alignment of sheets by the sheet aligning device 202, the gripping driving mechanism for the movable grip plate 17 comprising component 27*c*, operates to move the movable grip plate 17 and grip or grasp the aligned sheet bundle together with the fixed grip plate 16, as shown in FIG. 3(*a*). Upon completion of gripping of the sheet bundle, the moving mechanism for the movable grip plate 17 and the fixed grip plate 16 operates to convey the aligned sheet bundle from the sheet aligning device 202 to the tape heating device 204 while gripping the sheet bundle, as shown in FIG. 3(*c*).

At that time, the lower side of a rear portion of the sheet bundle is supported by the sheet-bundle guide 18 comprising components 18*a*, 18*b* and 18*c*.

The sheet-bundle guide 18 also moves together with the movable grip plate 17 and the fixed grip plate 16.

The tape heating device 204 comprises tape guides 19 and 20, a central heater 21, side heaters 22 and 23, a driving mechanism 24 for the central heater 21, a driving mechanism 25 for the side heaters 22 and 23, and the like (see FIG. 1).

A binding tape 26 has been supplied to the tape guides 19 and 20 of the tape heating device 204 by the tape conveying device 205 before the aligned sheet bundle is conveyed by the sheet-bundle conveying device 203.

The tape conveying device 205 comprises tape reels R1 and R2, a carriage conveyor C, a tape cutter 42, tape conveying means 43 and 44, and the like (see FIG. 1).

Figure 5:
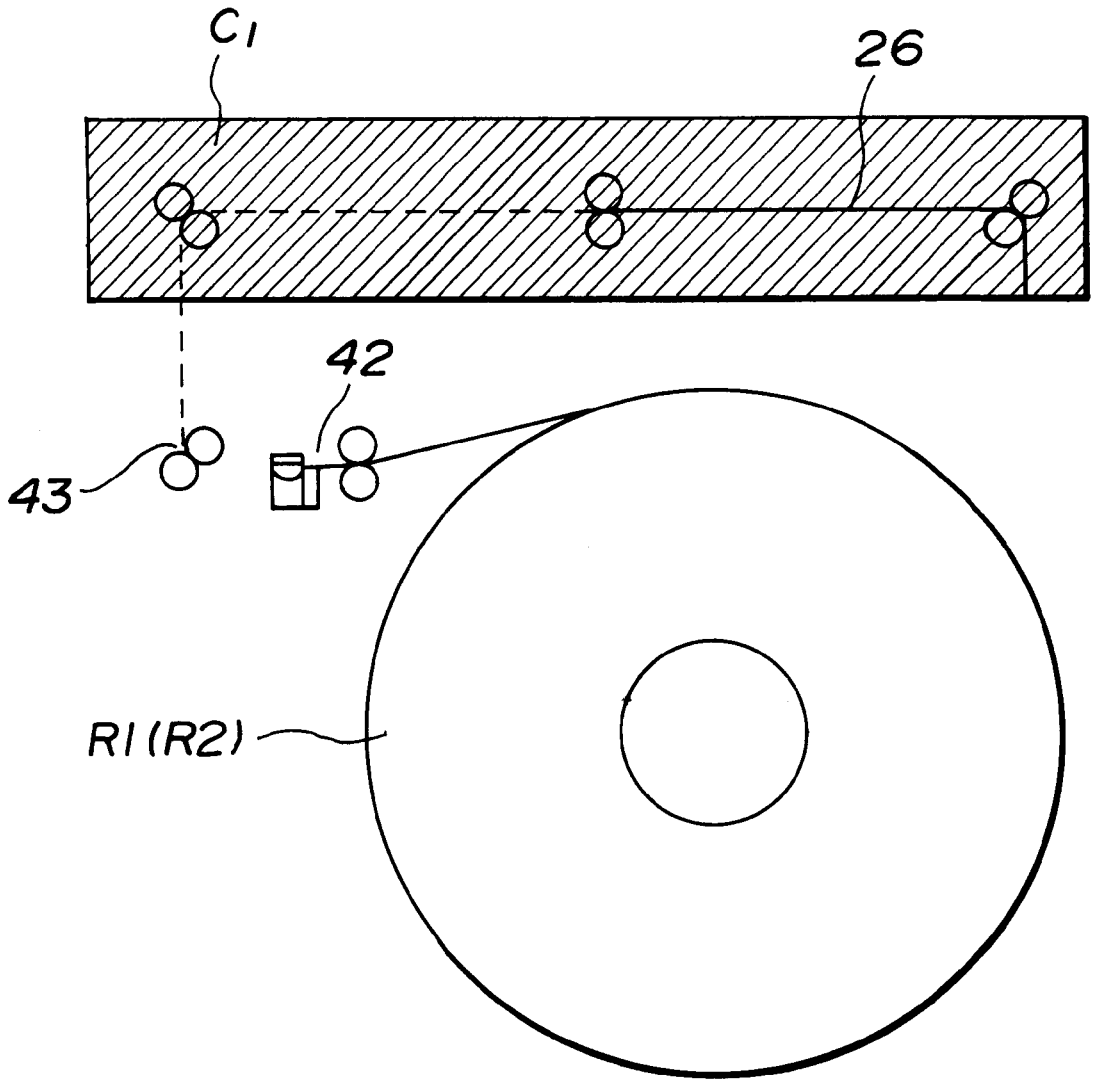
FIGS. 5 through 7 are diagrams illustrating operations of a tape conveying device.

As shown in FIG. 5, a tape, wound around the tape reels R1 and R2 (R2 is not visible in FIG. 5) is cut into a predetermined length by the tape cutter 42 to provide a binding tape 26, which is conveyed into the carriage conveyor C by the tape conveying means 43.

Figure 6:
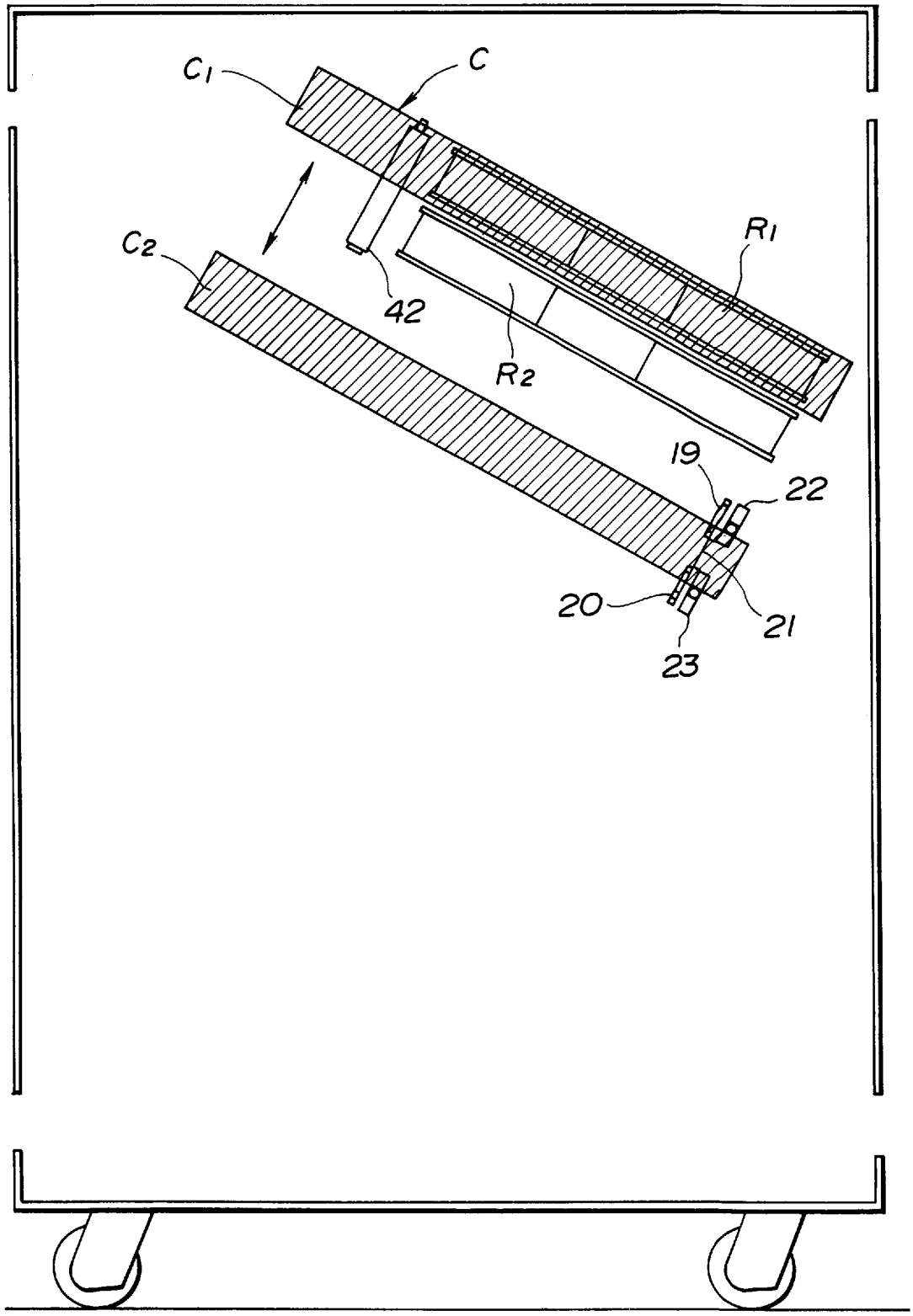

When the binding tape 26 has been conveyed into the carriage conveyor C by the tape conveying means 43, the carriage conveyor C moves, as shown by the arrow in FIG. 6, from a tape receiving position C1 to a tape transferring position C2.

Figure 7:
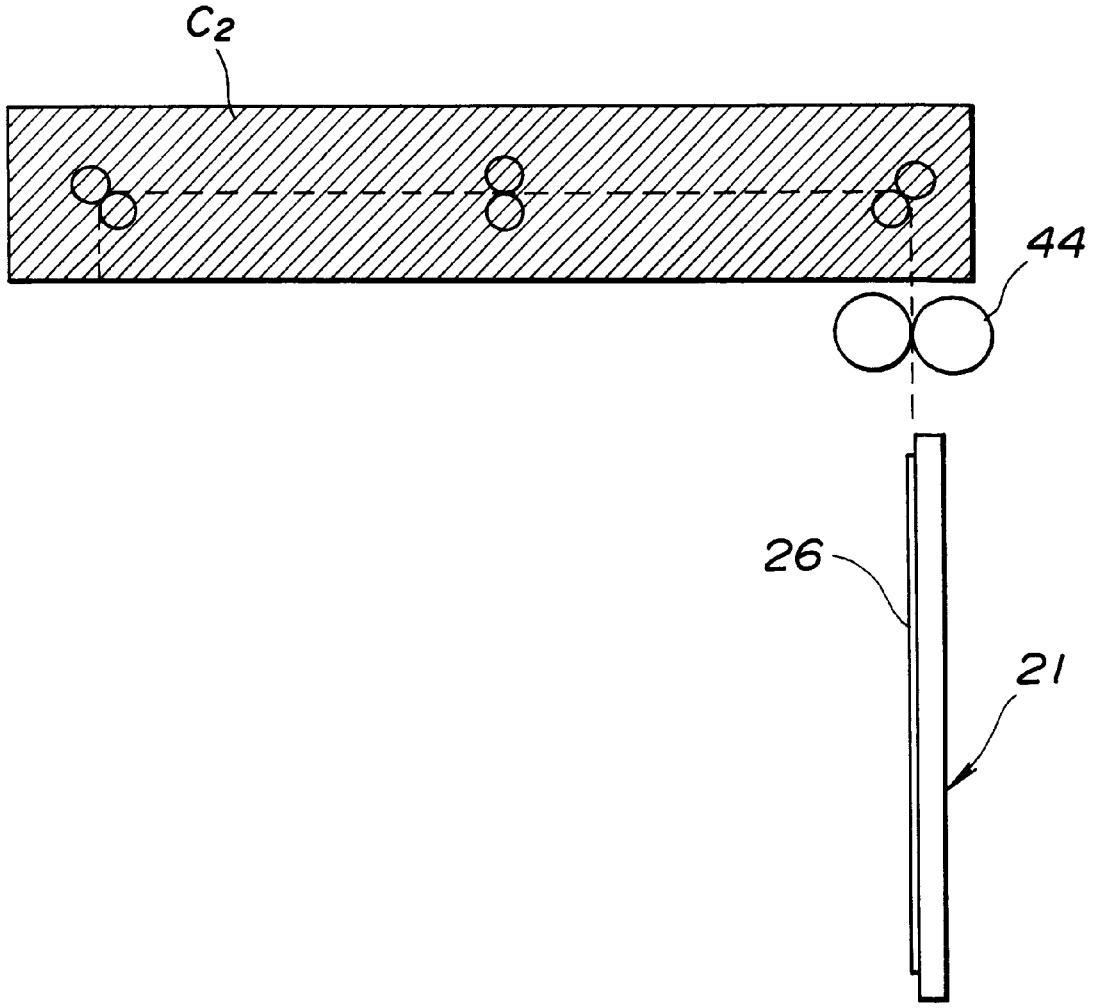

Upon completion of movement of the carriage conveyor C from the tape receiving position C1 to the tape transferring position C2, the binding tape 26 is supplied to the tape guides 19 and 20 by the tape conveying means 44, as shown in FIG. 7.

After supply of the binding tape 26, the central heater 21 moves from a retracted position (not shown) to a heating position (see FIG. 1) by the driving mechanism 24 for the central heater 21 and starts preheating of the binding tape 26. When the aligned sheet bundle has been conveyed to a back contact position H by the sheet-bundle conveying device 203, the back side of the sheet bundle is bound.

Upon completion of binding of the back side of the sheet bundle, the side heaters 22 and 23 are moved by the driving mechanism 25 while retracting (not shown) the tape guides 19 and 20 and raising end portions of the binding tape 26, and then begins binding of the sides of the sheet bundle Sb while holding the sheet bundle Sb therebetween.

Upon completion of binding of the sides of the sheet bundle, the pressing of the side heaters 22 and 23 is released.

Figure 4A:
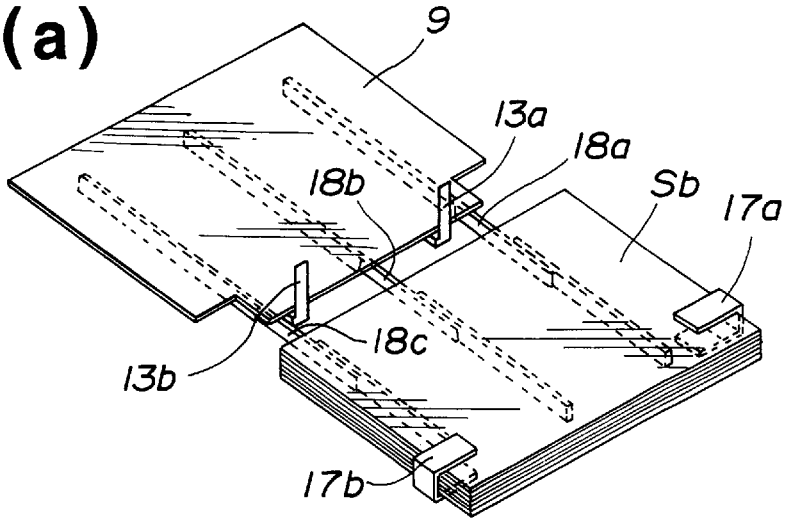
Figure 4B:
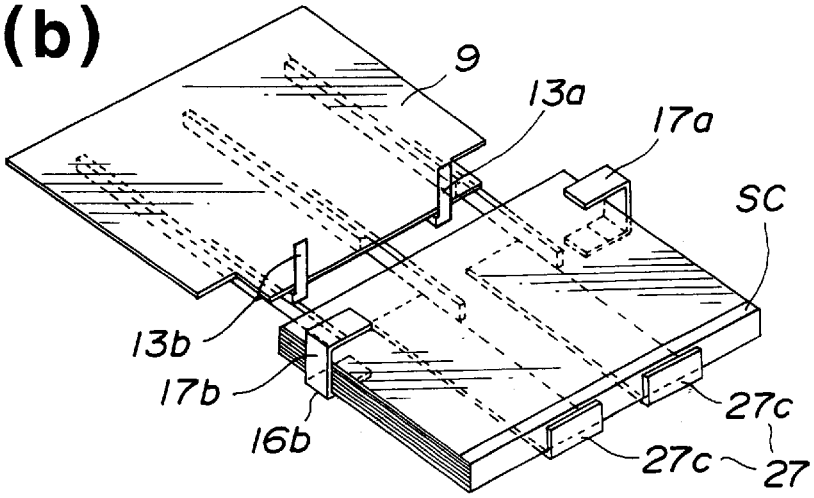
Figure 4C:
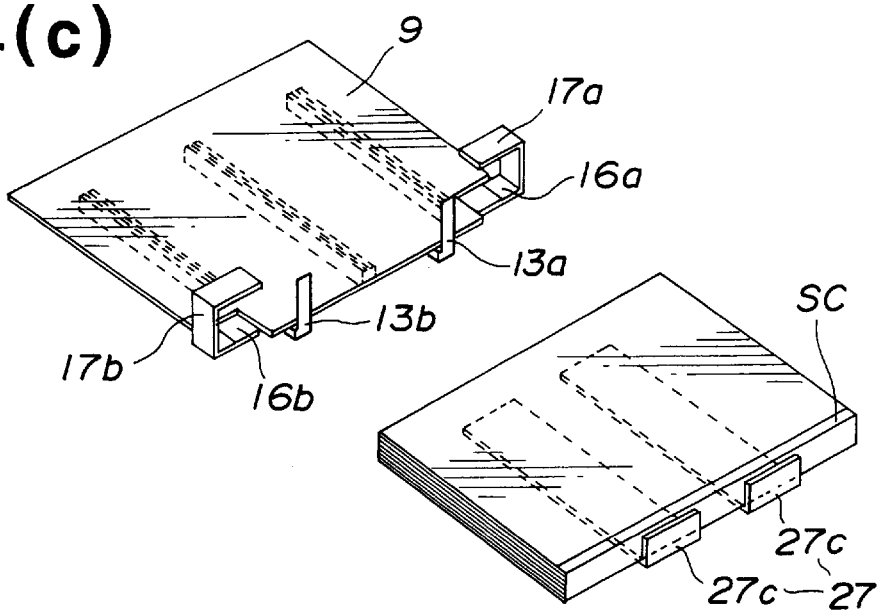

Upon release of the pressing of the side heaters 22 and 23, the bound end product SC is conveyed from the back contact position H to a transferring position to the bound-bundle conveying device 206 (see FIG. 4(*a*)).

The central heater 21, and the side heaters 22 and 23 return to retracted positions by the driving mechanism 24 for the central heater 21, and the driving mechanism 25 for the side heaters 22 and 23, respectively, in order to supply the next binding tape to the tape guides.

As shown in FIG. 1, the bound-bundle conveying device 206 comprises rocking or rotating trays 27, a horizontally moving tray 28, driving means 29 and 30 for the rotating trays 27, driving means 31 comprising components 31*a* and 31*b* (see FIGS. 10 and 11) of the horizontally moving tray 28, vertically moving means 33 and 34, motor M and the like.

When the bound end product SC has been conveyed from the back contact position H to the transferring position to the bound-bundle conveying device 206 by the sheet-bundle conveying device 203, the rotating trays 27 are moved to a bound-end-product receiving position by the driving means 29 and 30.

Upon completion of movement of the rotating trays 27 to the bound-end-product receiving position, the gripping of the movable grip plate 17 and the fixed grip plate 18 of the sheet-bundle conveying device 203 is released, and the bound end product SC is transferred to the rotating trays 27. Then, the sheet-bundle conveying device 203 returns to an aligned-sheet gripping position of the sheet aligning device 202 (see FIG. 4(*b*)).

Upon reception of the bound-end-product SC (see FIG. 4(*c*)), the rotating trays 27 are moved to a position T (see FIG. 1) to receive the horizontally moving tray 28 by the driving means 29 and 30.

Figure 8A:
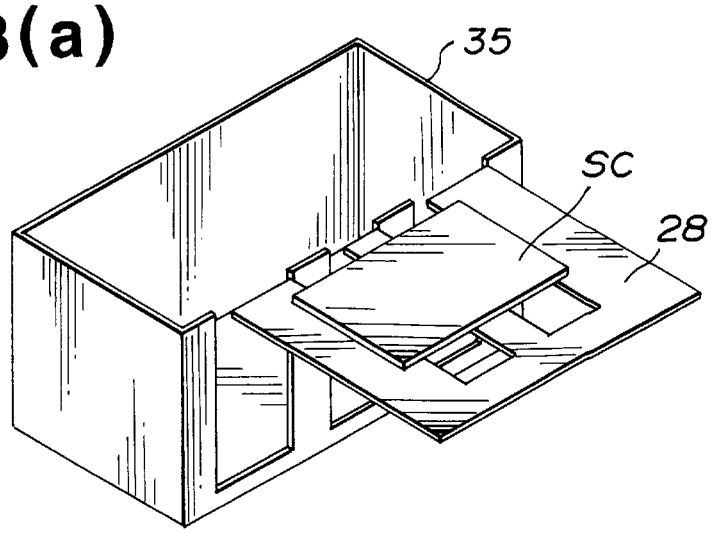
FIGS. 8(*a*) through 8(*c*) are diagrams illustrating a state of accommodating a bound bundle in an accommodating stacker.
Figure 8B:
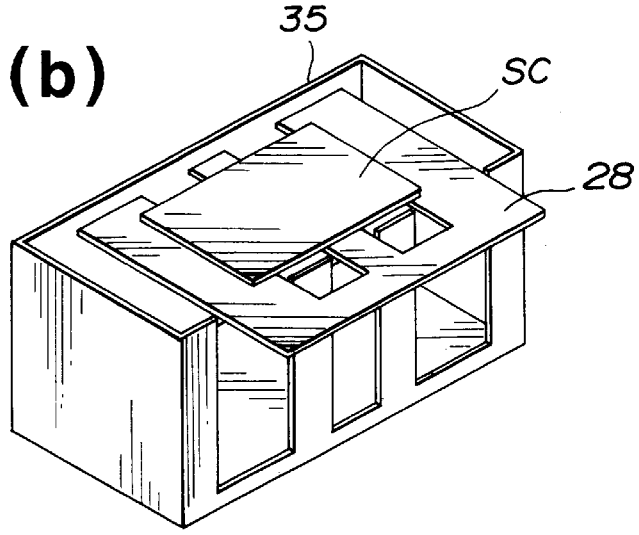
Figure 8C:
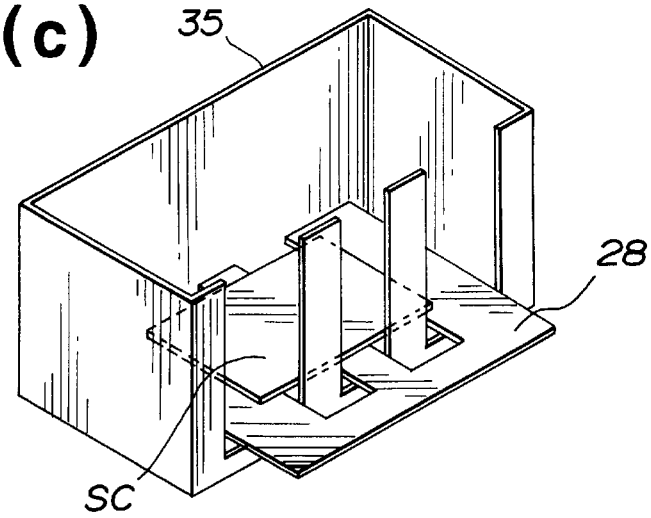

Upon reception of the bound-end-product SC at the receiving position T, the horizontally moving tray 28 is moved from a side (see FIG. 8(*a*)) to a position above the accommodating stacker 35 (see FIG. 8(*b*)) by the driving means 31*a* and 31*b* (see FIGS. 10 and 11), and the bound-end-product SC is caused to descend within the accommodating stacker 35 through openings in a sidewall of stacker 35 by the vertically moving means 33 and 34 (see FIG. 8(*c*)). The bound-end-product SC is accommodated within the accommodating stacker 35 by the movement of the horizontally moving tray 28 so as to be separated from the horizontally moving tray 28.

Next, a description will be provided of the configuration and the operation of the bound-bundle conveying device 206 of the present invention with reference to FIGS. 9 through 19.

Figure 9:
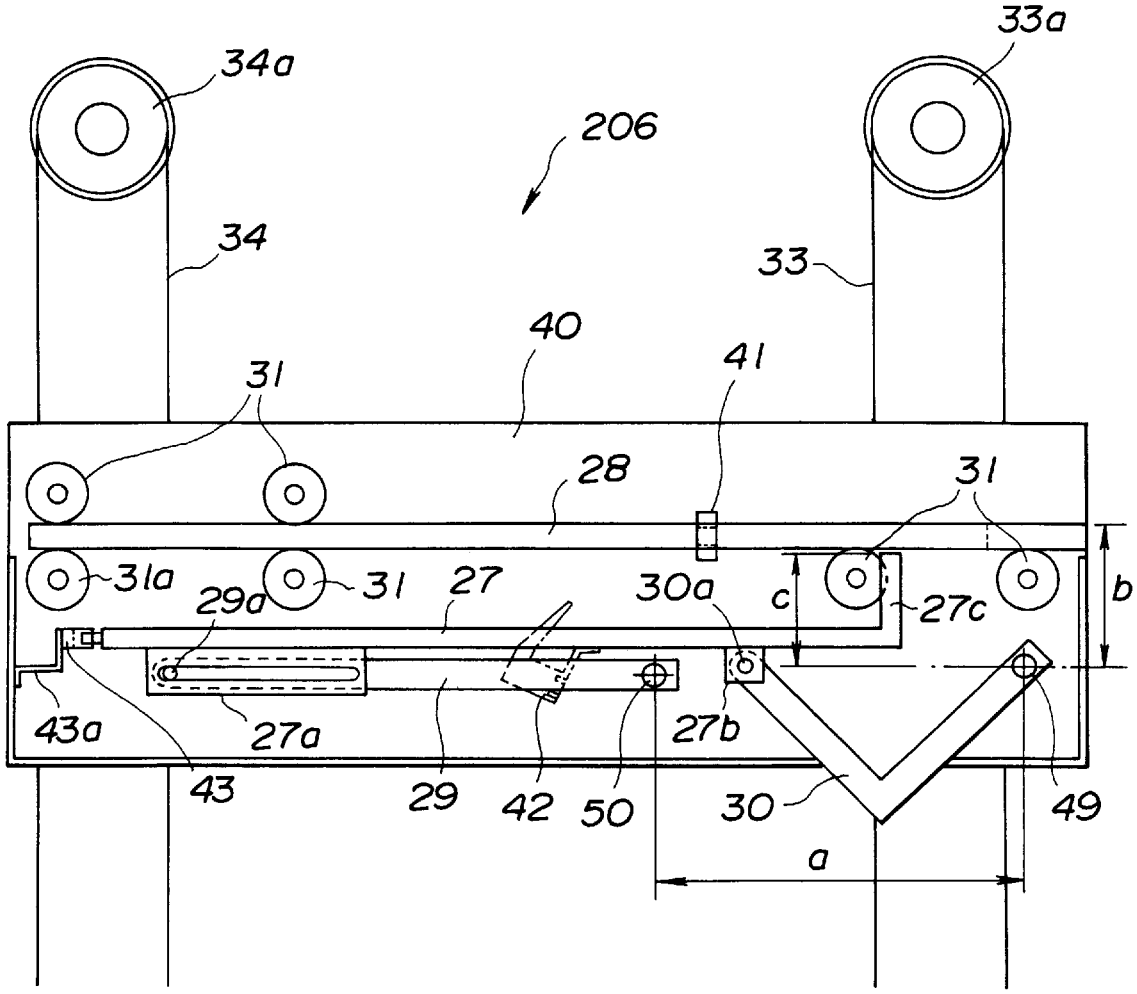
FIG. 9 is a side view of the bound-bundle conveying device.
Figure 10:
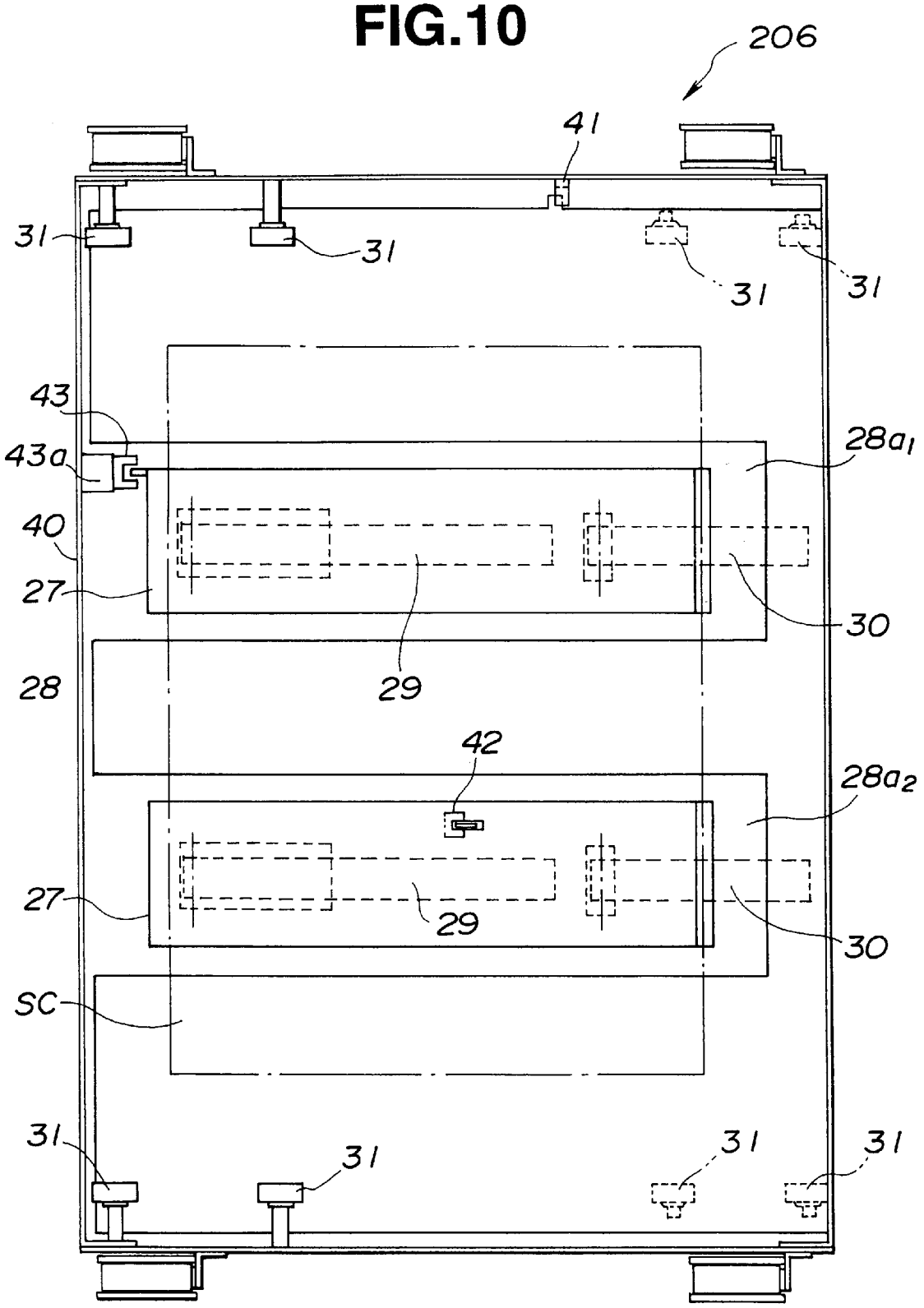
FIG. 10 is a plan view of the bound-bundle conveying device.
Figure 11:
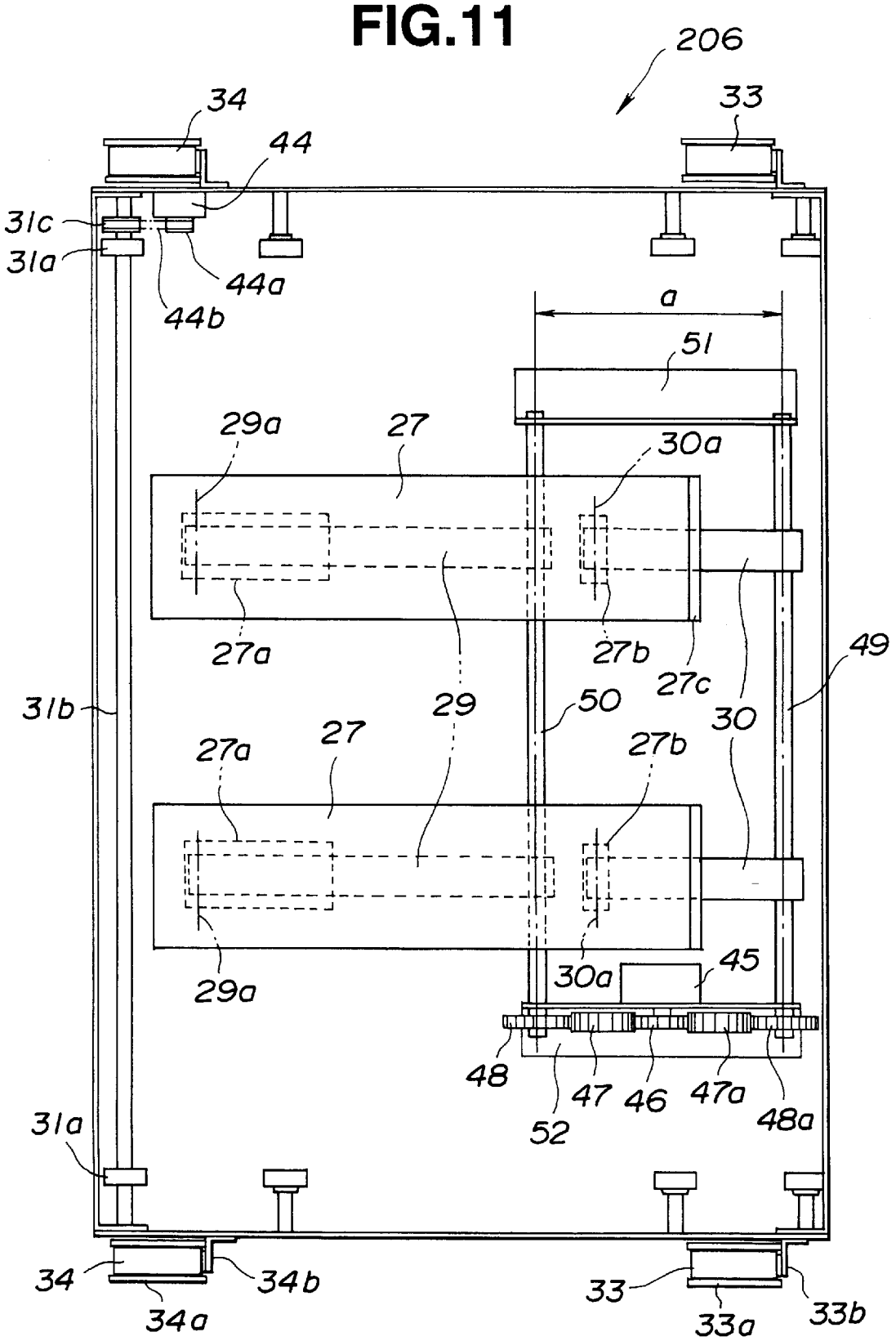
FIG. 11 is a plan view illustrating the bound-bundle conveying device in a state in which a horizontally moving tray is removed.

FIG. 9 is a cross-sectional view of the bound-bundle conveying device. FIG. 10 is a plan view of the bound-bundle conveying device. FIG. 11 is a plan view of the bound-bundle conveying device after removing the horizontally moving tray 28. The bound-bundle conveying device 206 comprises a frame 40 suspended from four timing belts 33 and 34, belt fixing plates 33*b* and 34*b* for connecting the timing belts 33 and 34 to the frame 40, respectively, a home-position sensor 41 for detecting the home position of the horizontally moving tray 28, a home-position sensor 43 for detecting the home position of the rotating trays 27, a sensor mount 43*a* for mounting the home-position sensor 43, and a bound-bundle detection sensor 42 provided in one of the rotating trays 27.

Each of the rotating trays 27 has a portion 27*c* to contact a bound bundle, and connecting portions 27*a* and 27*b* with driving links 29 and 30, respectively. The connecting portion 27*a* has sliding slits at both sides, where a slider 29*a* is slidably fitted. The connecting portion 27*b* is pivoted on the driving link 30 via a shaft 30*a*.

In the present embodiment, two rotating trays 27 are provided in parallel, and the width of the two rotating trays 27 is smaller than the width of the bound bundle SC.

Figure 12:
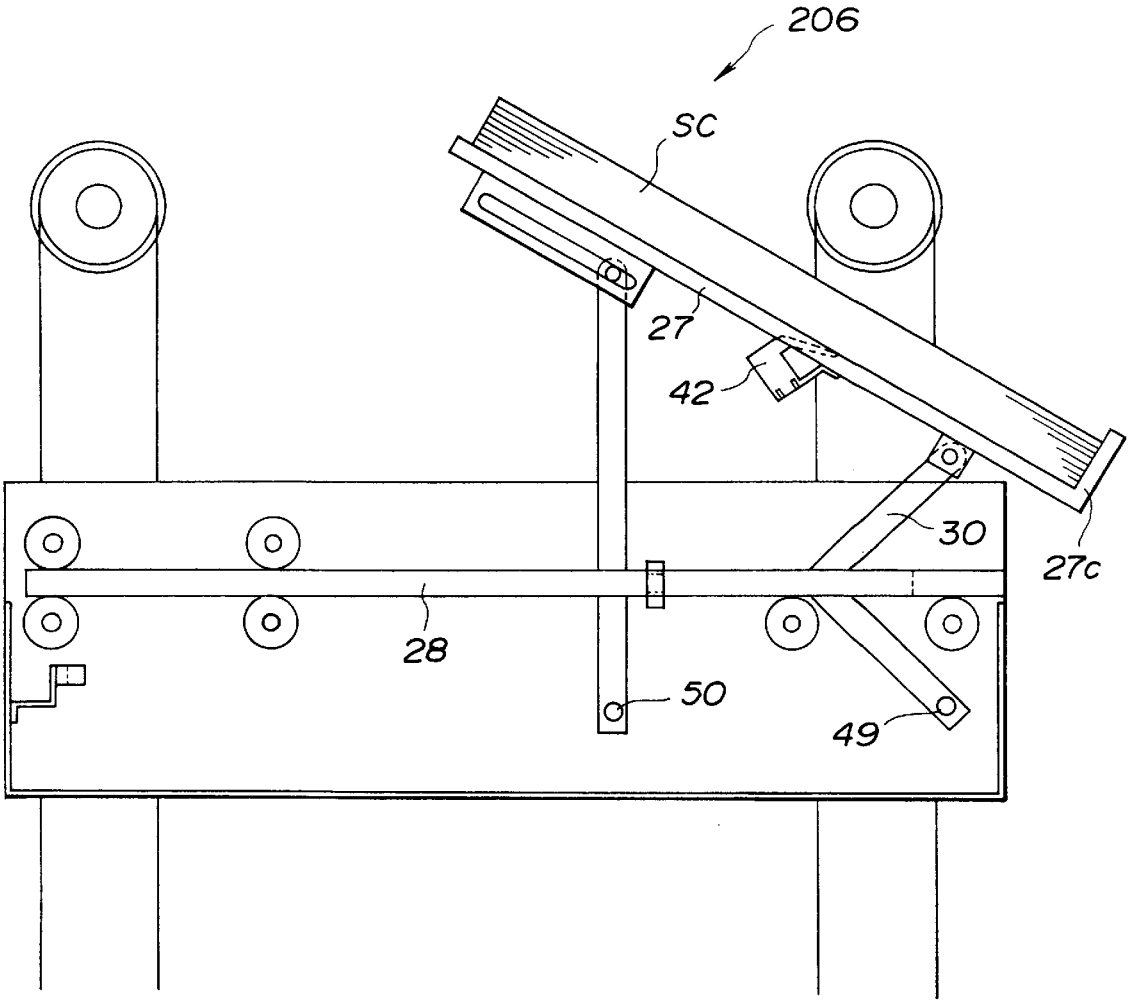
FIGS. 12 through 15 are diagrams illustrating operations of the bound-bundle conveying device.

The driving link 30 is formed at an angle of about 90° in order to prevent interference with the horizontally moving tray 28 when the driving link 30 rotates clockwise and reaches the uppermost position (see FIG. 12).

The driving links 29 and 30 are fixed to driving shafts 50 and 49, respectively. As shown in FIG. 11, the torque of a stepping motor 45 is transmitted via gears 46, 47, 47*a*, 48 and 48*a* to rotate the driving shafts 50 and 49 by a predetermined amount. The driving shafts 50 and 49 are supported on pivoting plates 52 and 51 via bearings.

The horizontally moving tray 28 has a comb-teeth-like, e.g. an ∃-like, shape, and incorporates the rotating trays 27 within two spaces or slots 28*a*1 and 28*a*2. The horizontally moving tray 28 is supported by rollers 31, and is driven by driving rollers 31*a*.

The driving rollers 31*a* are formed on a through shaft 31*b*. The driving rollers 31*a* are driven by the torque of a motor 44 via pulleys 44*a* and 31*c* and a timing belt 44*b*.

In the present embodiment, the driving rollers 31*a* are made of rubber.

In the present embodiment, the driving shafts 49 and 50 are on substantially the same plane with a center distance "a" of about 95 mm (see FIG. 9). The distance "b" between the driving shafts 49 and 50 and the horizontally moving tray 28 is 38 mm. The height "c" of the contact portion 27*c* from the driving shafts 49 and 50 is 30 mm. The lengths of the driving links 29 and 30 are 125 mm and 70 mm, respectively.

By the rotation of the driving shafts 49 and 50 by 90° at the same speed with the center distance and the lengths of the links as described above, the rotating trays 27 are inclined from a substantially horizontal state by 30° in a clockwise direction to be raised as shown in FIG. 12 (about 70 mm at the contact portion 27*c*).

In addition, the rotation and vertical movement of a rotating tray can be effected by the torque of a single drive source. By changing the ratio of the number of revolutions of a first driving shaft to the number of revolutions of a second driving shaft, or by changing the ratio of the length of a first driving link to the length of a second driving link, a predetermined angle can be arbitrarily set. By changing the length of the first driving link, the amount of vertical movement of the rotating tray can be set.

Next, the operation of the device will be described. The bound end product SC is made to be in a waiting state at the tranferring position by the sheet-bundle conveying device 203 (see FIG. 4(*a*)).

Then, the bound-bundle conveying device 206 rises 50 mm from the home position toward the transferring position.

Then, the rotating trays 27 reach the transferring position by the rotation of the driving shafts 49 and 50 by about 90° by the rotation of the stepping motor 45. At that time, the bound-bundle detection sensor 42 operates by the bound-end-product SC to confirm that the bound-end-product SC is present. Then, the sheet-bundle conveying device 203 releases the gripping of the bound-end-product SC, and returns to the aligned-sheet gripping position (see FIGS. 4(*b*) and 4(*c*)).

At that time, since the bound-end-product SC is transferred in a state in which its lower surface is held on the rotating trays 27, disturbance or the like in the bound bundle does not occur (see FIG. 12).

Figure 13:
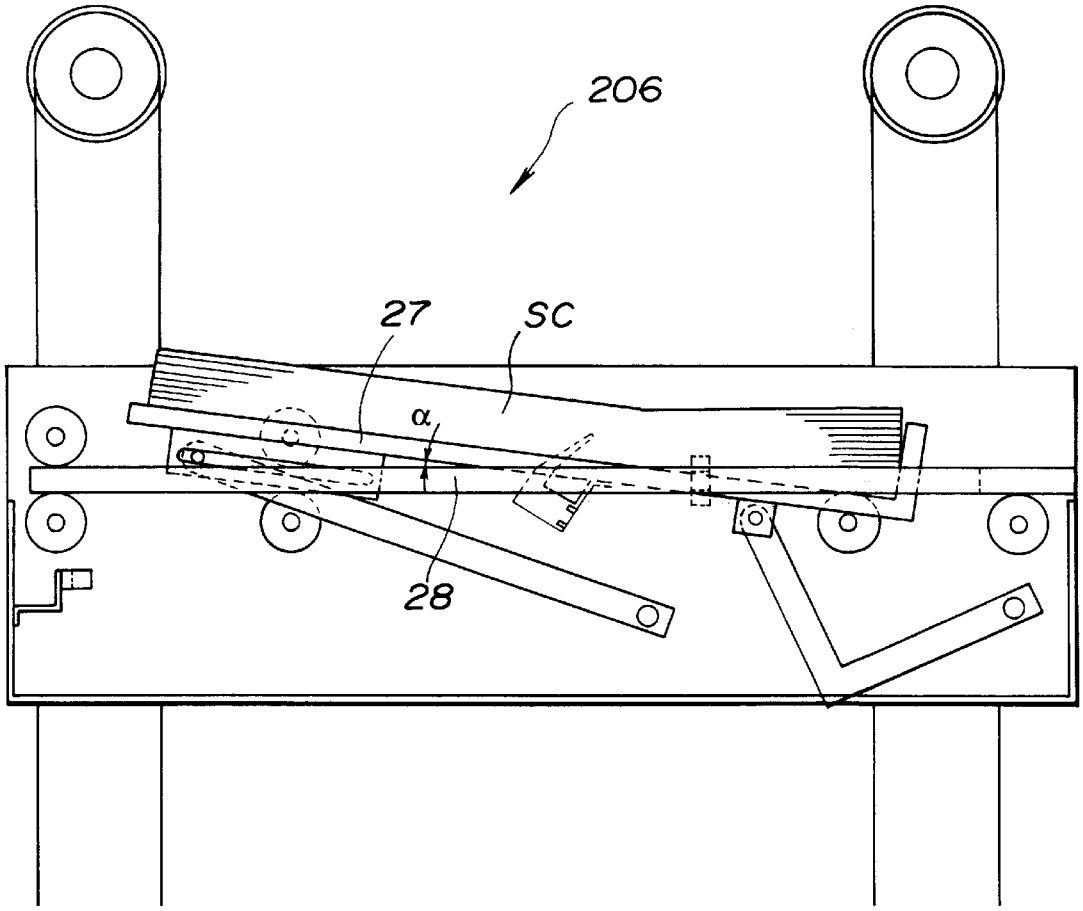

After the sheet-bundle conveying device 203 has reached the aligned-sheet gripping position, the rotating trays 27 mounting the bound-end-product SC are lowered by rotating the stepping motor 45 in a reverse direction. At that time, as shown in FIG. 13, the bound-end-product SC is transferred when the rotating trays 27 meet the horizontally moving tray 28.

At that time, the crossing angle $\alpha$ between the rotating trays 27 and the horizontally moving tray 28 is equal to or less than 15°. Hence, a large bending load is not applied to the bound-end-product SC, and therefore disturbance in the bound bundle can be prevented.

Figure 14:
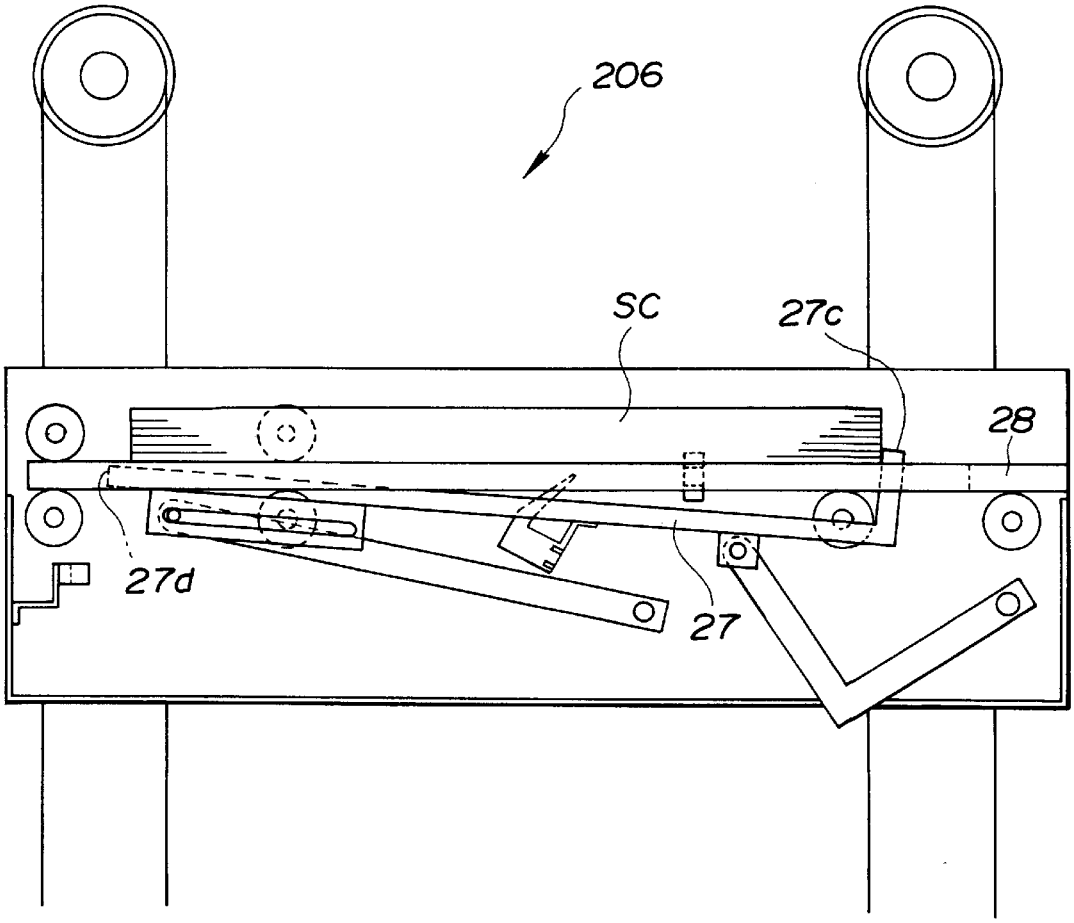

As shown in FIG. 14, when the rotating trays 27 further descend, the rear ends 27*d* of the rotating trays 27 descend lower than the horizontally moving tray 28 before the contact portions 27*c* of the rotating trays 27 descend lower than the horizontally moving tray 28.

Thus, the leading edge of the bound-end-product SC is regulated by the contact portion 27*c* until the bound-end-product SC is in a horizontal state. Hence, the bound-end-product SC does not slide down, and the position where the bound-end-product SC is placed is always maintained constant.

Figure 15:
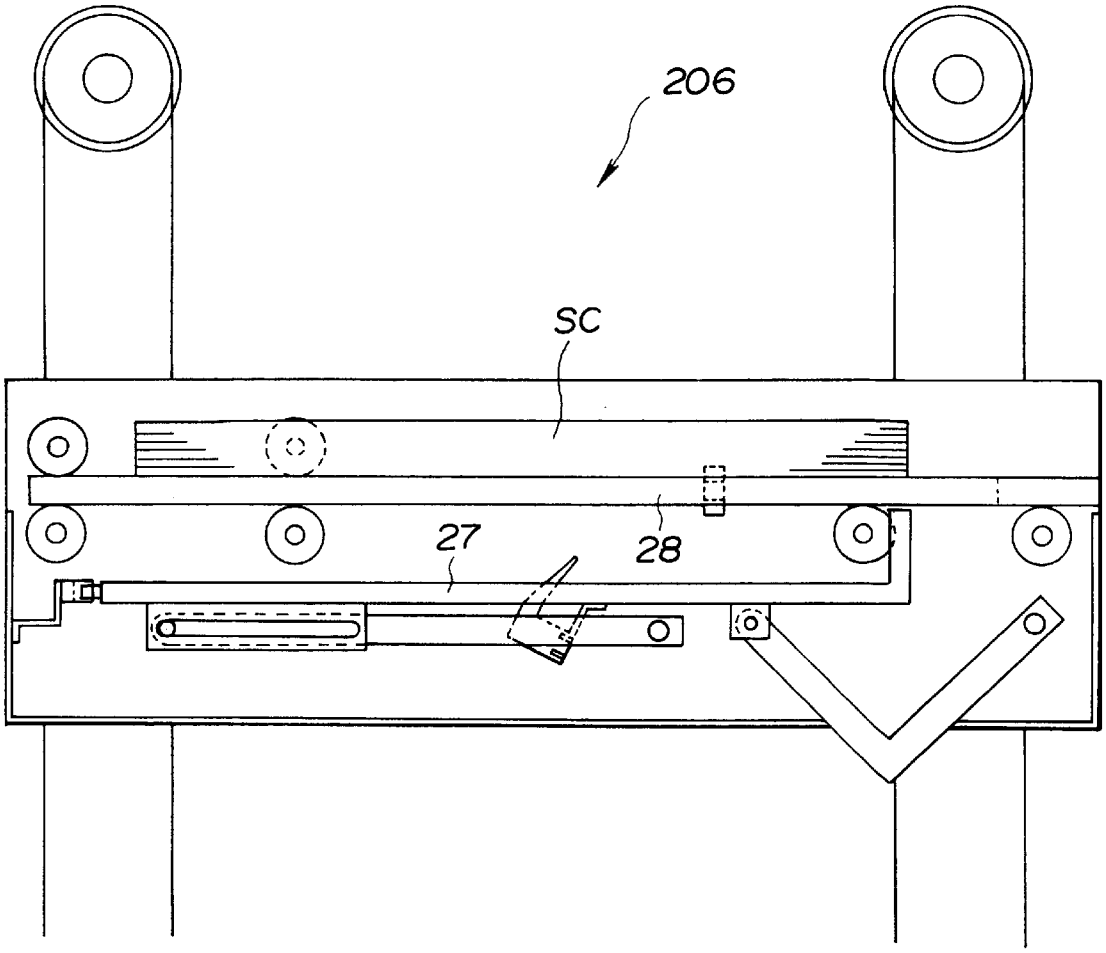

FIG. 15 illustrates a state in which the rotating trays 27 return to the home position, and the bound-end-product SC is completely transferred.

Figure 16:
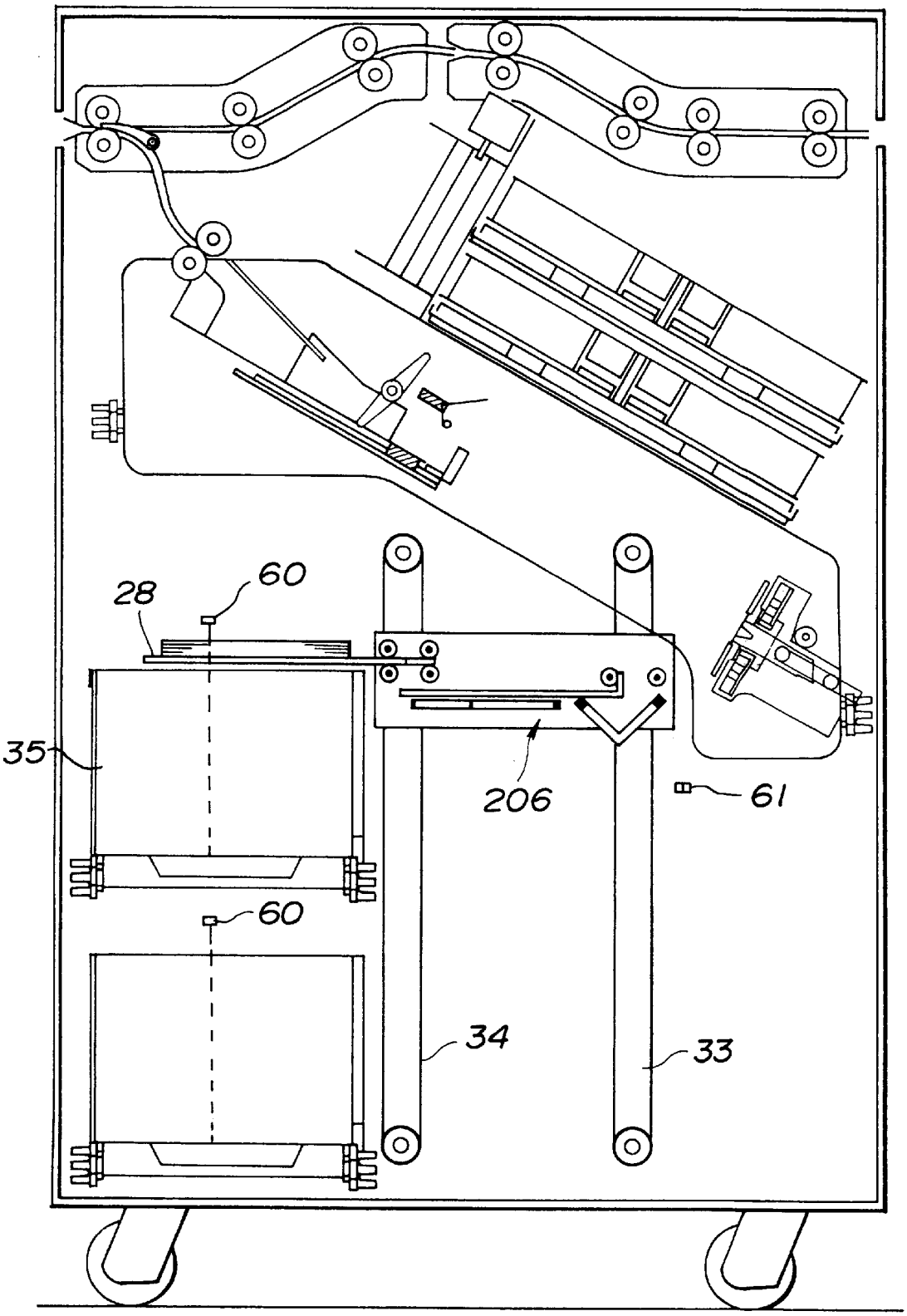
FIGS. 16 through 19 are diagrams illustrating a state of accommodating a bound bundle in an accommodating stacker by the bound-bundle conveying device.

FIG. 16 illustrates a state in which the bound-bundle conveying device 206 moves the horizontally moving tray 28 to the left through openings in a sidewall of stacker 35 at a position where the bound-bundle conveying device 206 rises 50 mm from the home position (the position of a home position sensor 61). The height of the bounded bundle mounted on the stacker 35 is detected by a distance sensor 60, and the distance of descent of the bound-bundle conveying device 206 is calculated. For that purpose, descent-amount control means is provided between the sensor 60 and a motor M (to be described later).

Figure 17:
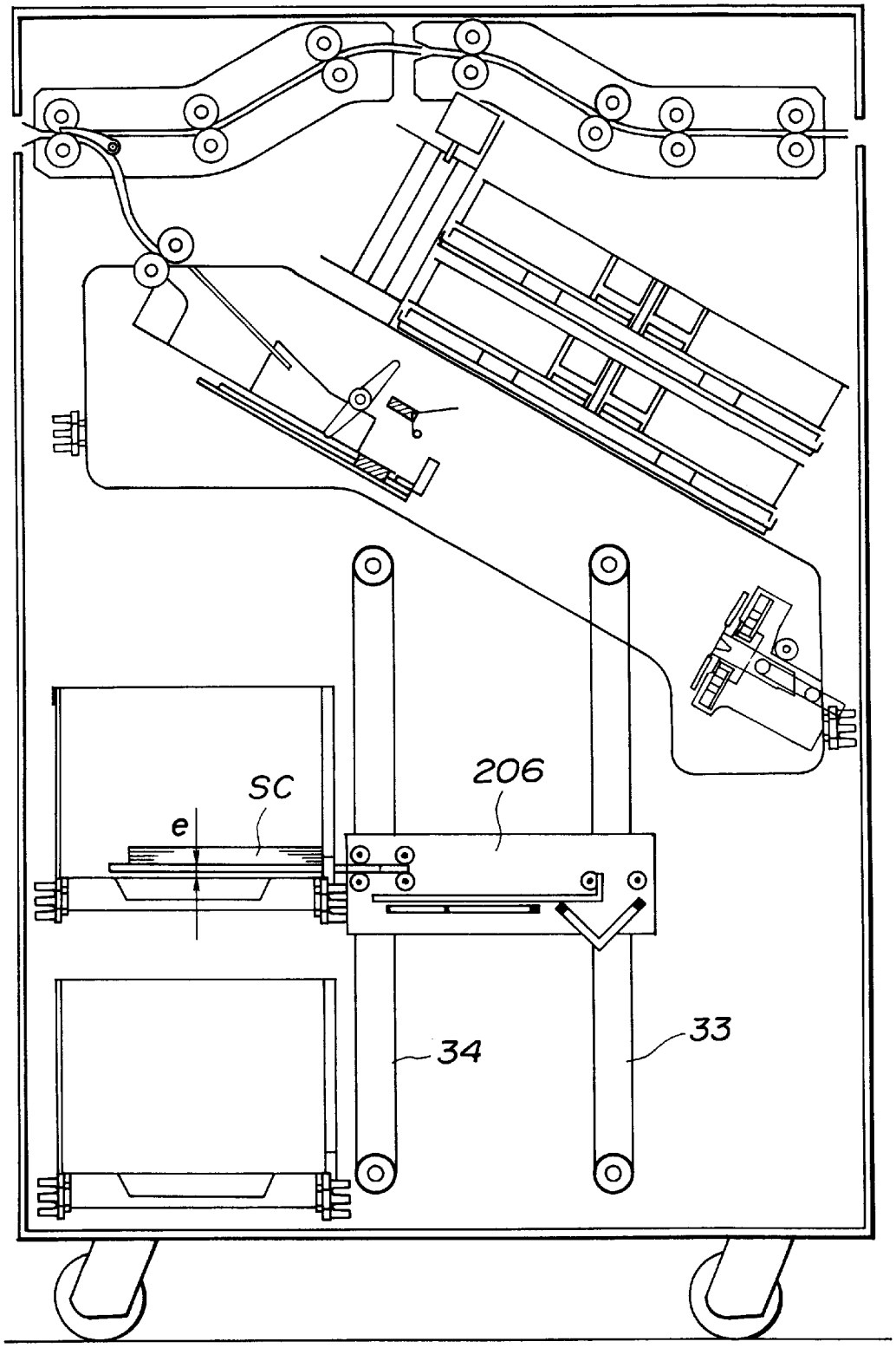
Figure 18:
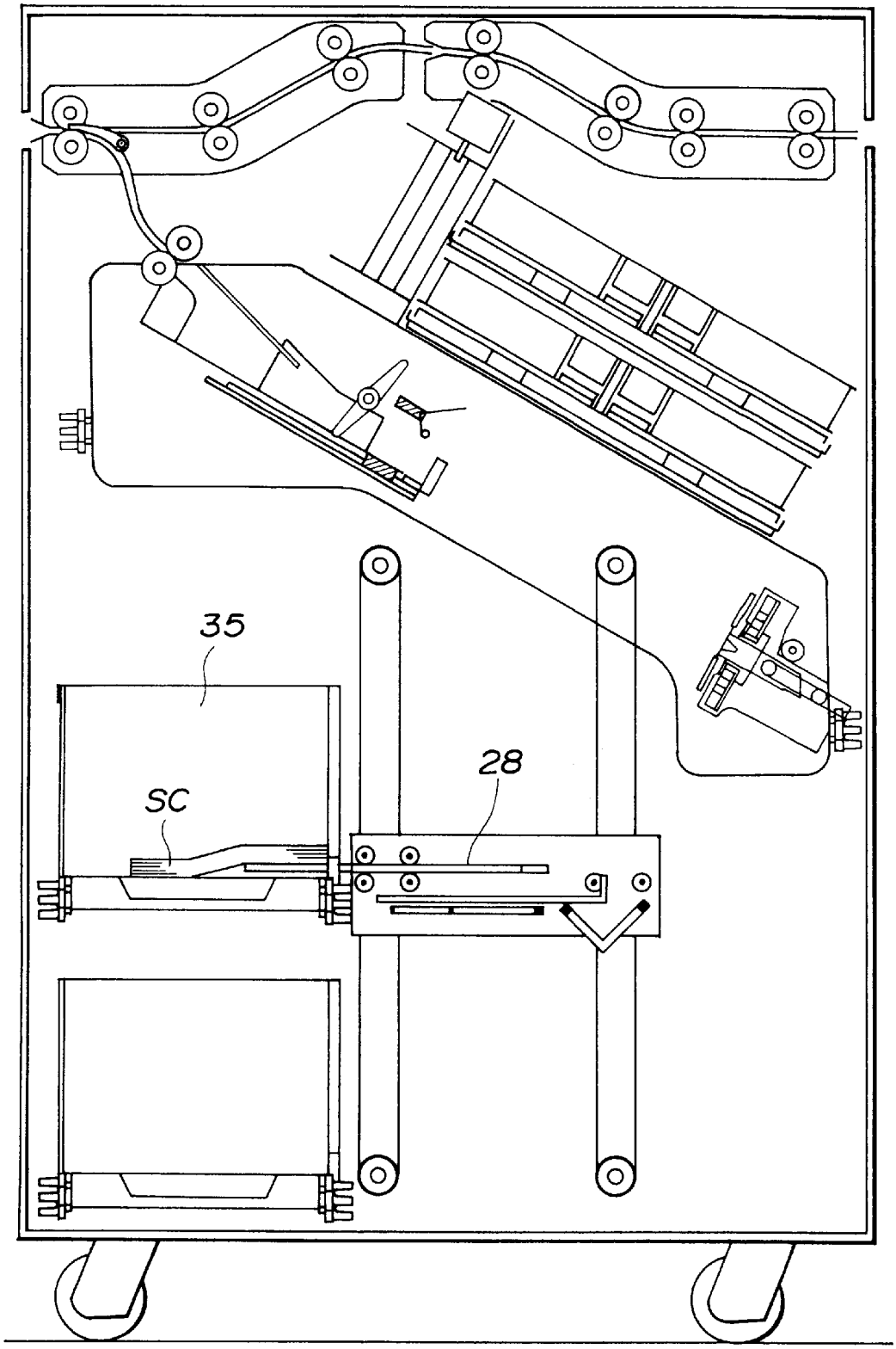

As shown in FIG. 17, the amount of descent "e" of the hound end product SC is preferably less than 20 mm, and is set to 15 mm in the present embodiment.

The bound-bundle conveying device 206 is vertically moved by driving the timing belts 34 and 33 by the rotation of the stepping motor M.

In the present embodiment, the posture of the bound-bundle conveying device 206 is maintained by hanging the bound-bundle conveying device 206 by four timing belts and providing belt tension. By thus omitting holding means, such as sliding rails or the like, the size and the cost of the device are reduced.

Then, the horizontally moving tray 28 is moved to the right, and the bound-end-product SC is placed on the stacker 35. At that time, although some amount of bending load is applied to the bound-end-product SC when it descends about 15 mm, the amount of the bending load is less than a level which will produce disturbance in the bound bundle (see FIG. 18).

Figure 19:
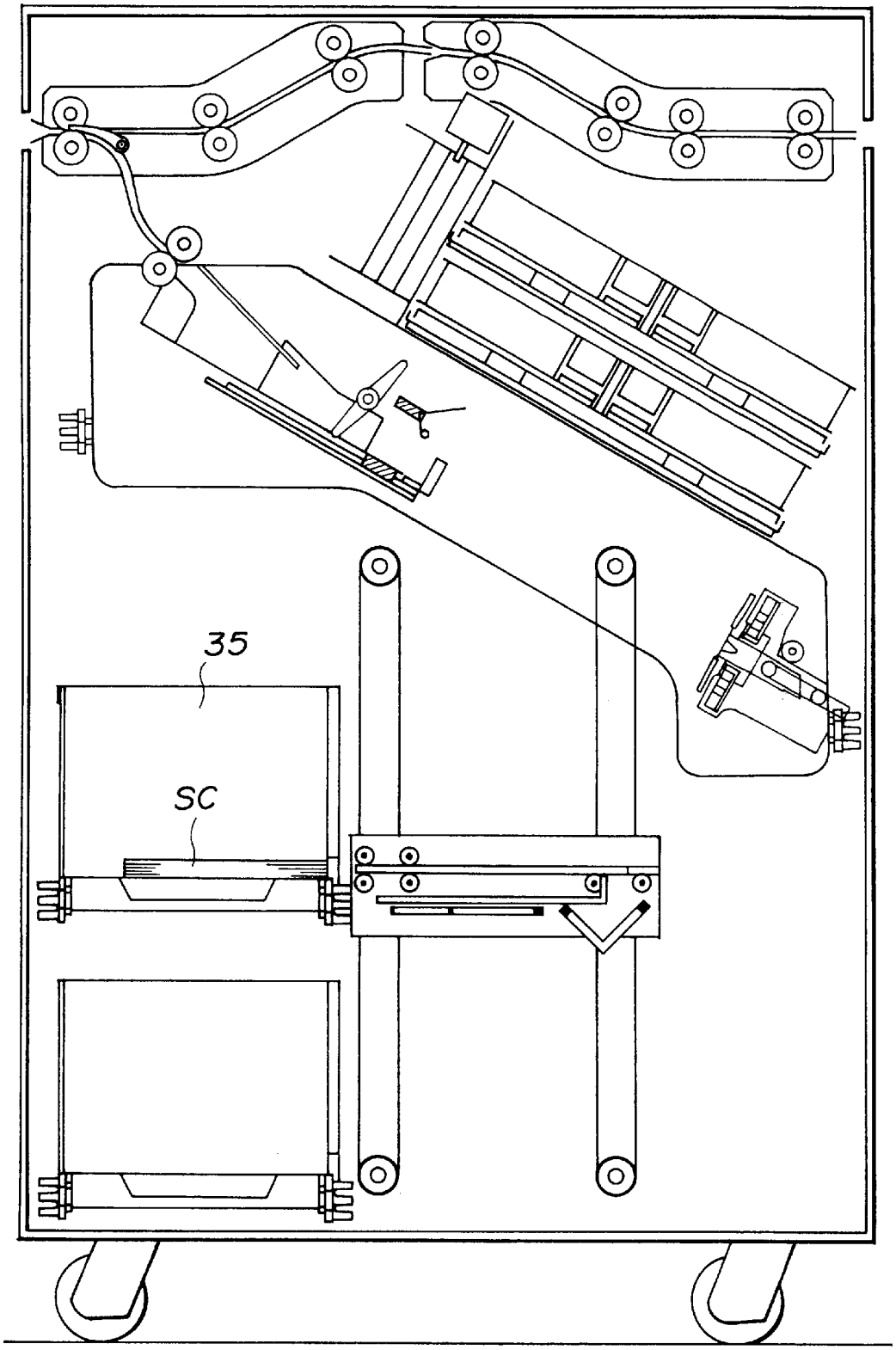
Figure 20:
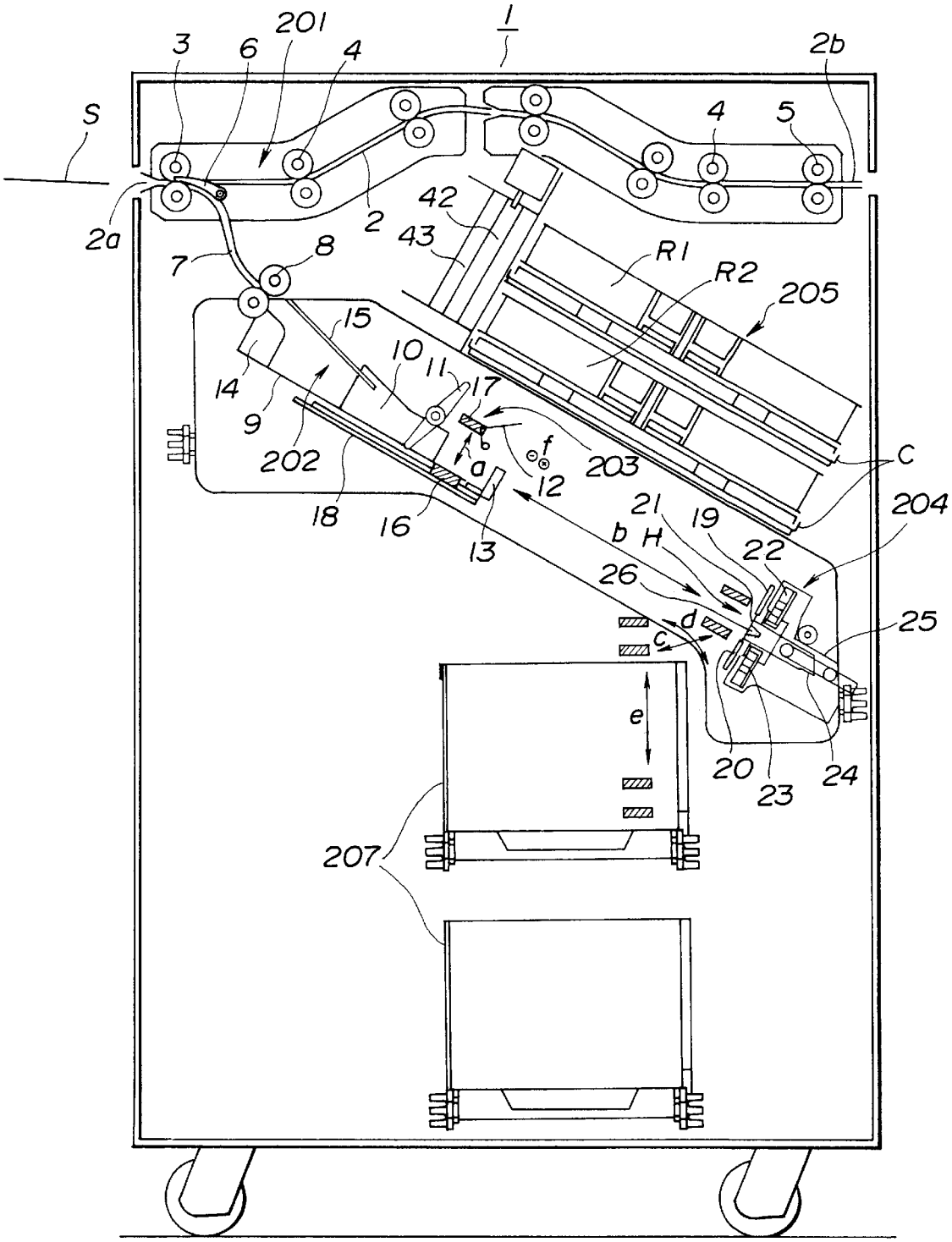
FIG.20 RELATED ART
FIG. 20 is a side view of a conventional binding apparatus in the related art.

FIG. 19 illustrates a state in which the bound-end-product SC is completely accommodated in the stacker 35.

Then, the bound-bundle conveying device 206 returns to the original state by rising from the position of FIG. 19 to the position of FIG. 1. Thereafter, the above-described processing is repeated.

The individual components shown in outline in the drawings are all well known in the sheet-bundle conveying device arts and their specific construction and operation are not critical to the operation or the best mode for carrying out the invention.

While the present invention has been described with respect to what is presently considered to be the preferred embodiment, it is to be understood that the invention is not limited to the disclosed embodiment. To the contrary, the present invention is intended to cover various modifications and equivalent arrangements included within the spirit and scope of the appended claims. Ths scope of the following claims is to be accorded the broadest interpretation so as to encompass all such modifications and equivalent structures and functions.

What is claimed is:

1. A sheet-bundle conveying device for receiving and conveying a bundle of the sheets, said device comprising:

first tray means having a contact portion where the edges of the sheets contact, and being swingable between a first position, inclined so that the contact portion is lowered, for receiving the sheets and a second position for transferring the received sheet bundle; and second tray means for receiving the sheet bundle from said first tray means moved to the second position and for rectilinearly moving and conveying the sheet bundle.

2. A device according to claim 1, wherein said first tray means can pass through openings formed in said second tray means, and wherein, when said first tray means passes through said openings, the sheet bundle is transferred to said second tray means.

3. A device according to claim 2, wherein said first tray means is supported by supporting means so that, when said first tray means transfers the sheet bundle to said second tray means, a portion at a far side from the contact portion of said first tray means descends lower than said second tray means, and subsequently the contact portion of said first tray means descends.

4. A device according to claim 3, wherein said supporting means comprises a first driving link for rotatably supporting said first tray means, and a second driving link for slidably/rotatably supporting said first tray means in cooperation with said first driving link.

5. A device according to claim 4, wherein said driving links are fixed to a first driving shaft and a second driving shaft, respectively, and wherein the driving shafts are driven by a single drive source.

6. A device according to claim 2, further comprising a stacker for receiving the sheet bundle conveyed by said second tray means, wherein said second tray means is vertically movable in order to transfer the sheet bundle to said stacker.

7. A device according to claim 6, wherein sides of said stacker are formed in a comb-teeth-like shape so that said second tray means can vertically move in openings formed in a sidewall of said stacker.

8. A device according to claim 1, further comprising:

sheet aligning means, provided at a side upstream of said first tray means, for forming a sheet bundle by individually receiving fed sheets; and conveying means for conveying the sheet bundle formed by said sheet aligning means to said first tray means.

9. A device according to claim 8, further comprising binding means for binding the sheet bundle aligned by said sheet aligning means.

10. A sheet-bundle conveying device for receiving and conveying a bundle of the sheets, said device comprising:

first tray means having a contact portion where the edges of the sheets contact, and being movable between a first position for receiving the sheets and a second position for transferring the received sheet bundle; and second tray means for receiving the sheet bundle from said first tray means moved to the second position and for conveying the sheet bundle, wherein, when said first tray means passes through openings formed in said second tray means, whereby the sheet bundle is caused to remain on said second tray means, and wherein said first means is supported by supporting means so that, when said first tray means transfers the sheet bundle to said second tray means, a portion at a far side from the contact portion of said first tray means descends.

11. A device according to claim 10, wherein said supporting means comprises a first driving link for rotatably supporting said first tray means, and a second driving link for slidably/rotatably supporting said first tray means in cooperation with said first driving link.

12. A device according to claim 11, wherein said driving links are fixed to a first driving shaft and a second driving shaft, respectively, and wherein the driving shafts are driven by a single drive source.

13. A device according to claim 10, further comprising a stacker for receiving the sheet bundle conveyed by said second tray means, wherein said second tray means is vertically movable in order to transfer the sheet bundle to said stacker.

14. A device according to claim 13, wherein sides of said stacker are formed in a comb-teeth-like shape so that said second tray means can vertically move in openings formed in a sidewall of said stacker.

15. A device according to claim 10, further comprising:

sheet aligning means, provided at a side upstream of said first tray means, for forming a sheet bundle by individually receiving fed sheets; and conveying means for conveying the sheet bundle formed by said sheet aligning means to said first tray means.

16. A device according to claim 15, further comprising binding means for binding the sheet bundle aligned by said sheet aligning means.

17. A sheet-bundle conveying device comprising:

a first movable tray for receiving sheets and for moving up and down;

a second tray for receiving the sheets when said first tray descends through openings formed in said second tray;

first moving means for moving said second tray in a direction crossing the descending direction;

second moving means for moving said first tray up and down; and conveying means movable up and down as one body while supporting said first tray, said second tray, said first moving means, and said second moving means.

18. A device according to claim 17, wherein said first tray reciprocatingly swings by being supported by a drive link mechanism, and wherein said second tray reciprocatingly moves substantially horizontally by being guided by rotating members.

19. A binding apparatus comprising:

aligning means for aligning sheets which are sequentially fed, and having a contact portion for maintaining the position of the bundle of sheets by contacting the bundle of sheets mounted on a tray having a predetermined angle;

conveying means for conveying an aligned bundle of sheets to a binding portion while gripping the aligned sheet bundle, and for conveying the bound bundle bound in the binding portion to a bound-bundle accommodating portion;

a first movable tray for receiving the bound bundle and being movable up and down;

a second tray for receiving the bound bundle when said first tray descends through openings formed in the second tray means;

first moving means for moving the second tray in a direction crossing a descending direction;

second moving means for moving said first tray up and down; and conveying means movable up and down as one body while supporting the first tray, the second tray, the first moving means and the second moving means.

20. A binding apparatus having a binding means and a sheet-bundle conveying device for receiving and conveying a bundle of the sheets bound by said binding means, said device comprising:

first tray means having a contact portion where the edge of the sheets contact, and being swingable between a first position, inclined so that the contact portion is lowered, for receiving the sheet bundle and a second position for transferring the received sheet bundle; and second tray means for receiving the sheet bundle from said first tray means moved to the second position and for rectilinearly moving and conveying the sheet bundle.

21. A binding apparatus having a binding means and a sheet-bundle conveying device for receiving and conveying a bundle of the sheets bound by said binding means, said device comprising:

first tray means having a contact portion where the edge of the sheets contact, and being movable between a first position for receiving the sheets and a second position transferring the received sheet bundle; and second tray means for receiving the sheet bundle from said first tray means moved to the second position and for conveying the sheet bundle, wherein, when said first tray means passes through openings formed in said second tray means, whereby the sheet bundle is caused to remain on said second tray means, and wherein said first tray means is supported by supporting means so that, when said first tray means transfers the sheet bundle to said second tray means, a portion at a far side from the contact portion of said first tray means descends lower than said second tray means, and subsequently the contact portion of said first tray means descends.

* * * * *

UNITED STATES PATENT AND TRADEMARK OFFICE

CERTIFICATE OF CORRECTION

PATENT NO. : 5,899,138

DATED : May 4, 1999

INVENTOR(S) : YUJI YAMANAKA

It is certified that error appears in the above-identified patent and that said Letters Patent is hereby corrected as shown below:

COLUMN 2,
Line 41, "approach" should read --approach,--.

COLUMN 3,
Line 46, "opening" should read --openings--.

COLUMN 8,
Line 31, "tranferring" should read --transferring--.

COLUMN 9,
Line 13, "bounded" should read --bound--; and
Line 20, "hound" should read --bound--.

Signed and Sealed this

Twenty-eighth Day of December, 1999

*Attest:*

Q. TODD DICKINSON

*Attesting Officer*

*Acting Commissioner of Patents and Trademarks*